US010181288B2

(12) United States Patent
Hu et al.

(10) Patent No.: US 10,181,288 B2
(45) Date of Patent: Jan. 15, 2019

(54) PIXEL CIRCUIT, DISPLAY PANEL, DISPLAY DEVICE AND DRIVING METHOD

(71) Applicants: SHANGHAI TIANMA AM-OLED CO., LTD., Shanghai (CN); TIANMA MICRO-ELECTRONICS CO., LTD., Shenzhen (CN)

(72) Inventors: Xiaoxu Hu, Shanghai (CN); Li Zhang, Shanghai (CN); Zhiyang Gao, Shanghai (CN)

(73) Assignees: SHANGHAI TIANMA AM-OLED CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 107 days.

(21) Appl. No.: 15/391,711

(22) Filed: Dec. 27, 2016

(65) Prior Publication Data

US 2017/0110058 A1 Apr. 20, 2017

Related U.S. Application Data

(62) Division of application No. 14/479,644, filed on Sep. 8, 2014, now Pat. No. 9,570,001.

(30) Foreign Application Priority Data

Apr. 29, 2014 (CN) ..... 2014 1 0180477

(51) Int. Cl.
*G09G 5/00* (2006.01)
*G09G 3/32* (2016.01)
(Continued)

(52) U.S. Cl.
CPC ..... *G09G 3/3258* (2013.01); *G09G 3/003* (2013.01); *G09G 3/3208* (2013.01);
(Continued)

(58) Field of Classification Search
None
See application file for complete search history.

(56) References Cited

U.S. PATENT DOCUMENTS

2002/0097252 A1* 7/2002 Hirohata ..... G09G 3/20 345/690
2008/0259005 A1* 10/2008 Sano ..... G09G 3/2088 345/76
(Continued)

*Primary Examiner* — Christopher R Lamb
(74) *Attorney, Agent, or Firm* — Alston & Bird LLP

(57) ABSTRACT

An organic light-emitting diode pixel circuit addresses problems associated with power consumption of a conventional 3D image display using two displayed adjacent frames of image signals that are spaced by a black picture. The pixel circuit includes a signal pre-storage module for storing a signal in a current frame of image signal, when the voltage of a first drive signal is higher than the voltage of a second drive signal and a gate line connected with the pixel is enabled; and a drive module for driving a drive transistor when the voltage of the first drive signal is higher than the voltage of the second drive signal; and to generate a current drive signal from the signal stored in the signal pre-storage module in the current frame of image signal, when the voltage of the first drive signal is not higher than the voltage of the second drive signal.

9 Claims, 6 Drawing Sheets

(51) Int. Cl.

| | |
|---|---|
| ***G09G 3/3258*** | (2016.01) |
| ***G09G 3/3208*** | (2016.01) |
| ***G09G 3/3225*** | (2016.01) |
| ***G09G 3/3266*** | (2016.01) |
| ***G09G 3/3291*** | (2016.01) |
| ***G09G 3/00*** | (2006.01) |

(52) U.S. Cl.
CPC ..... *G09G 3/3225* (2013.01); *G09G 3/3266* (2013.01); *G09G 3/3291* (2013.01); *G09G 2300/043* (2013.01); *G09G 2300/0426* (2013.01); *G09G 2300/0819* (2013.01); *G09G 2300/0852* (2013.01); *G09G 2300/0861* (2013.01); *G09G 2300/0866* (2013.01); *G09G 2300/0876* (2013.01); *G09G 2320/0252* (2013.01); *G09G 2320/045* (2013.01); *G09G 2330/021* (2013.01)

(56) References Cited

U.S. PATENT DOCUMENTS

| | | | | |
|---|---|---|---|---|
| 2009/0219265 | A1* | 9/2009 | Lee | G09G 3/3291 345/205 |
| 2012/0146999 | A1* | 6/2012 | Hwang | G09G 3/003 345/419 |
| 2014/0002468 | A1* | 1/2014 | Sung | G09G 5/399 345/536 |
| 2014/0139505 | A1* | 5/2014 | Han | G09G 3/003 345/212 |
| 2015/0206496 | A1* | 7/2015 | Bae | G09G 3/3696 348/59 |

* cited by examiner

PIXEL CIRCUIT, DISPLAY PANEL, DISPLAY DEVICE AND DRIVING METHOD

CROSS-REFERENCES TO RELATED APPLICATIONS

This application is a divisional application of U.S. patent application Ser. No. 14/479,644, filed on Sep. 8, 2014, which is based upon and claims priority to Chinese patent application No. 201410180477.2 filed on Apr. 29, 2014, the content of which is incorporated herein by reference in its entirety.

BACKGROUND OF THE INVENTION

At present, numerous display schemes have been proposed to display a 3D image. A currently common driving scheme of active 3D shutter is to perform normal progressive scanning to separate an image signal of a picture of a 3D image into image data for the left eye and image data for the right-eye, so that the image signal corresponding to the image data for the left eye is recognized by a viewer with his or her left eye while the image signal corresponding to the image data for the left eye is being displayed, and the image signal corresponding to the image data for the right-eye is recognized by a viewer with his or her right-eye while the image signal corresponding to the image data for the right-eye is being displayed, and as such the 3D image can be recognized by the viewer.

However the displayed image signal corresponding to the image data for the left eye has to be spaced by a black picture from the displayed image signal corresponding to the image data for the right-eye in the driving scheme of active shutter 3D, so if the 3D image is displayed at the frequency of 60 Hz, then it has to be displayed by a display device up to 240 Hz, and therefore the black picture has to be displayed for half of the time during displaying of the 3D image by the display device, thus resulting in excessive power consumption of the display device.

BRIEF SUMMARY OF THE INVENTION

Embodiments of the invention provide an organic light-emitting diode pixel circuit, display panel, display device and driving method so as to address the problem, in the existing 3D image display scheme, of an increase in power consumption of a display panel because two displayed adjacent frames of image signals have to be spaced by a black picture.

In view of the foregoing problem, an embodiment of the invention provides an organic light-emitting diode pixel circuit including a signal pre-storage module, a drive module, an organic light-emitting diode and a drive transistor, wherein:

a first end of the signal pre-storage module receives a signal, in a current frame of image signal, to be displayed by a pixel including the pixel circuit, a second end of the signal pre-storage module receives a gate line scan signal, which is configured to control whether to enable a gate line connected with the pixel, a third end of the signal pre-storage module is connected with a second end of the drive module, and a fourth end of the signal pre-storage module is connected with a source of the drive transistor; a first end of the drive module is connected with a gate of the drive transistor, and a third end of the drive module is connected with the source of the drive transistor; and the source of the drive transistor receives a first drive signal, and a drain of the drive transistor is connected with an anode of the organic light-emitting diode, and the cathode of the organic light-emitting diode receives a second drive signal;

the signal pre-storage module is configured to store the signal received by the first end of the signal pre-storage module, in the current frame of image signal, to be displayed by the pixel, when the voltage of the first drive signal is higher than the voltage of the second drive signal and the gate line connected with the pixel is enabled; and the drive module is configured to drive the drive transistor by the first end of the drive module using a previous drive signal to enable the organic light-emitting diode to emit light when the voltage of the first drive signal is higher than the voltage of the second drive signal, wherein the previous drive signal is generated by the drive module from a signal, in a previous frame of image signal to the current frame of image signal, to be displayed by the pixel; and to generate a current drive signal from the signal stored in the signal pre-storage module, in the current frame of image signal, to be displayed by the pixel, when the voltage of the first drive signal is not higher than the voltage of the second drive signal.

An embodiment of the invention provides a display device including the organic light-emitting diode pixel circuit according to the embodiment of the invention.

An embodiment of the invention provides a method for driving an organic light-emitting diode pixel circuit, applicable to the organic light-emitting diode pixel circuit according to the embodiment of the invention, the method including:

storing, by the signal pre-storage module, the signal received by the first end of the signal pre-storage module, in the current frame of image signal, to be displayed the pixel, when the voltage of the first drive signal is higher than the voltage of the second drive signal and the gate line connected with the pixel is enabled;

driving, by the drive module, the drive transistor by the first end of the drive module using the previous drive signal to enable the organic light-emitting diode to emit light when the voltage of the first drive signal is higher than the voltage of the second drive signal, wherein the previous drive signal is generated by the drive module from a signal, in the previous frame of image signal to the current frame of image signal, to be displayed by the pixel; and generating, by the drive module, the current drive signal from the signal stored in the signal pre-storage module, in the current frame of image signal, to be displayed by the pixel, when the voltage of the first drive signal is not higher than the voltage of the second drive signal.

Advantageous effects of the embodiments of the invention are as follows:

With an Organic Light-Emitting Diode (OLED) pixel circuit, display panel, display device and drive method according to the embodiments of the invention, since the signal pre-storage module can store a current frame of image signal during the drive module drives the OLED by a previous frame of image signal to emit light, the previous frame of image signal can be replaced by the current frame of image signal on whole screen to display the current frame of image signal immediately at the end of displaying of the previous frame of image signal, so it is not required to have the two displayed adjacent frames of image signals spaced by a black picture to thereby lower the frequency at which they are displayed really, avoid an increase in power consumption of a display panel as a result of switching the display panel at a high speed and also dispense with power consumption of the display panel during displaying of the black picture, thus lowering power consumption of the display panel.

DETAILED DESCRIPTION OF THE INVENTION

With an organic light-emitting diode pixel circuit, display panel, display device and driving method according to embodiments of the invention, a current frame of image signal is pre-stored when a previous frame of image signal is displayed, so that the previous frame of image signal can be replaced by the current frame of image signal on entire screen to display the current frame of image signal immediately at the end of displaying of the previous frame of image signal, so it is not required to have the two displayed adjacent frames of image signals spaced by a black picture to thereby lower the frequency at which they are displayed, avoid an increase in power consumption of a display panel as a result of switching the display panel at a high speed and also dispense with power consumption of the display panel during displaying of the black picture, thus lowering power consumption of the display panel.

Particular implementations of an organic light-emitting diode pixel circuit, display panel, display device and driving method according to the embodiments of the invention will be described below with reference to the drawings.

Figure 1:
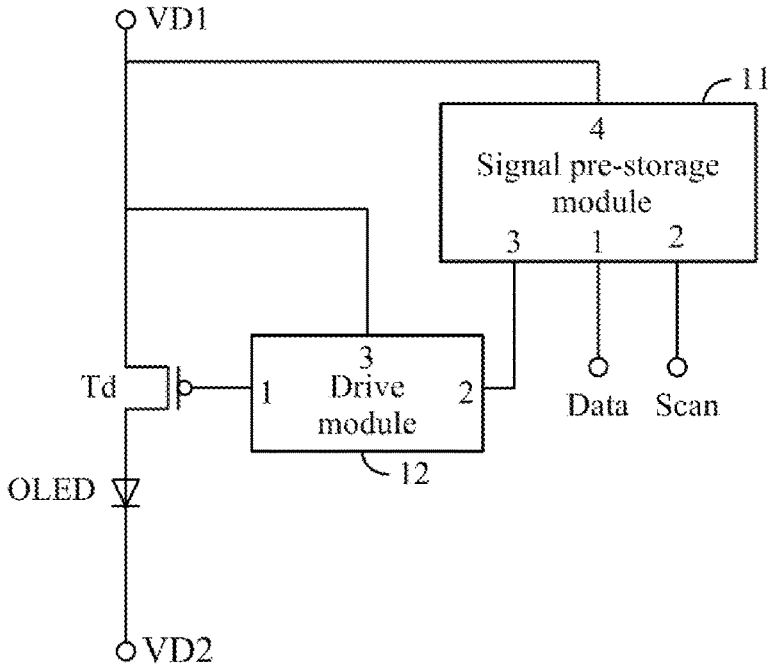
FIG. 1 is a simplified block diagram of an organic light-emitting diode pixel circuit according to an embodiment of the invention.

As illustrated in FIG. 1, an organic light-emitting diode pixel circuit according to an embodiment of the invention particularly includes a signal pre-storage module 11, a drive module 12, an Organic Light-Emitting Diode (OLED) and a drive transistor Td.

A first end 1 of the signal pre-storage module 11 receives a signal Data, in a current frame of image signal, to be displayed by a pixel including the pixel circuit, a second end 2 of the signal pre-storage module 11 receives a gate line scan signal Scan which is configured to control whether to enable a gate line connected with the pixel, a third end 3 of the signal pre-storage module 11 is connected with a second end 2 of the drive module 12, and a fourth end 4 of the signal pre-storage module 11 is connected with a source of the drive transistor Td; a first end 1 of the drive module 12 is connected with a gate of the drive transistor Td, and a third end 3 of the drive module 12 is connected with the source of the drive transistor Td; and the source of the drive transistor Td receives a first drive signal VD1, and a drain of the drive transistor Td is connected with an anode of the Organic Light-Emitting Diode (OLED), and the cathode of the Organic Light-Emitting Diode (OLED) receives a second drive signal VD2.

The signal pre-storage module 11 is configured to store the signal Data, to be displayed by the pixel, in the current frame of image signal received by the first end 1 of the signal pre-storage module 11, when the voltage of the first drive signal VD1 is higher than the voltage of the second drive signal VD2 and the gate line connected with the pixel is enabled.

The drive module 12 is configured to drive the drive transistor Td by the first end 1 of the drive module 12 using a previous drive signal to enable the Organic Light-Emitting Diode (OLED) to emit light when the voltage of the first drive signal VD1 is higher than the voltage of the second drive signal VD2, where the previous drive signal is generated by the drive module 12 from a signal, in a previous frame of image signal to the current frame of image signal, to be displayed by the pixel; and to generate a current drive signal from the signal Data stored in the signal pre-storage module 11, in the current frame of image signal, to be displayed by the pixel when the voltage of the first drive signal VD1 is not higher than the voltage of the second drive signal VD2.

Where the third end 3 of the signal pre-storage module 11 is configured to transmit the stored signal Data, in the current frame of image signal, to be displayed by the pixel to the drive module 12 by the second end 2 of the drive module 12.

With an Organic Light-Emitting Diode (OLED) pixel circuit according to the embodiment of the invention, since the drive module drives the drive transistor by a previous drive signal to enable the OLED to emit light when the voltage of the first drive signal is higher than the voltage of the second drive signal, where the previous drive signal is generated by the drive module from a signal, in a previous frame of image signal to the current frame of image signal, to be displayed by the pixel including the OLED pixel circuit; and the signal pre-storage module stores the signal, in the current frame of image signal, to be displayed by the pixel when the voltage of the first drive signal is higher than the voltage of the second drive signal and the gate line connected with the pixel is enabled, that is, the signal pre-storage module can store the current frame of image signal when the previous frame of image signal is displayed. Moreover, the drive module can further generate a current drive signal from the signal stored in the signal pre-storage module, in the current frame of image signal, to be displayed by the pixel when the voltage of the first drive signal is not higher than the voltage of the second drive signal, so that the drive module can drive the drive transistor by the current drive signal to enable the OLED to emit light at the next time when the voltage of the first drive signal is higher than the voltage of the second drive signal, that is, the drive module can display the current frame of image signal at the next time when the voltage of the first drive signal is higher than the voltage of the second drive signal. Thus, when pixel circuits of respective pixels in a display panel each are implemented by the OLED pixel circuit according to the embodiment of the invention, the previous frame of image signal can be replaced by the current frame of image signal on the whole screen to display the current frame of image signal immediately at the end of displaying of the previous frame of image signal, so it is not required to have the two displayed adjacent frames of image signals spaced by a black picture to thereby lower the frequency at which they are displayed really, avoid an increase in power consumption of a display panel as a result of switching the display panel at a high speed and also dispense with power consumption of the display panel during displaying of the black picture, thus lowering power consumption of the display panel.

Preferably, a period of time in which the voltage of the first drive signal is not higher than the voltage of the second drive signal includes a first period and a second period, where the first period precedes the second period; and both the first drive signal and the second drive signal are signals at a high level in both the first period and the second period.

Figure 2:
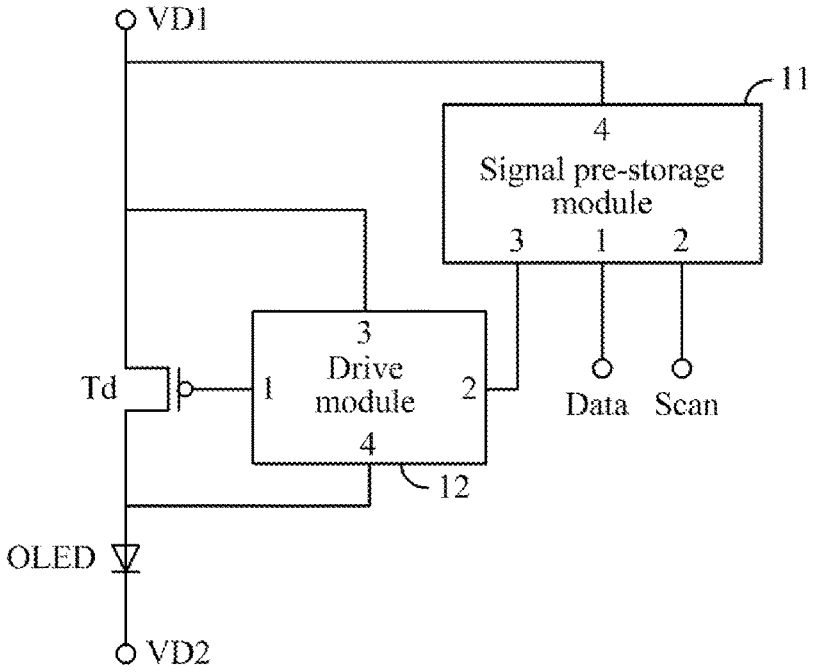
FIG. 2 is a simplified block of an organic light-emitting diode pixel circuit according to an embodiment of the invention.

In this case, the organic light-emitting diode pixel circuit according to the embodiment of the invention is as illustrated in FIG. 2, where a fourth end 4 of the drive module 12 is connected with the drain of the drive transistor Td.

The drive module 12 is configured, in the first period, to have the first end 1 of the drive module 12 connected with the fourth end 4 of the drive module 12 and read and store the threshold voltage of the drive transistor Td; and in the second period, to generate the current drive signal from a signal of the second end 2 of the drive module 12 and the signal of the first end 1 of the drive module 12, where the signal of the second end 2 of the drive module 12 is the signal Data stored in the signal pre-storage module 11, in the current frame of image signal, to be displayed by the pixel including the pixel circuit.

Since the drive module 12 reads and stores the threshold voltage of the drive transistor Td in the first period, the voltage of the signal of the first end 1 of the drive module 12 is Vd1+Vth at the end of the first period, where Vd1 is the voltage of the first drive signal VD1, and Vth is the threshold voltage of the drive transistor Td. The signal of the second end 2 of the drive module 12 is the signal of the third end 3 of the signal pre-storage module 11, i.e., the signal Data, in the current frame of image signal, to be displayed by the pixel, so the drive module 12 generates the current drive signal from the signal of the second end 2 of the drive module 12 and the signal of the first end 1 of the drive module 12 in the second period, i.e., by generating the current drive signal from the voltage VData of the signal of the second end 2 of the drive module 12 and the voltage Vd1+Vth of the signal of the first end 1 of the drive module 12.

Since the current drive signal, i.e., the signal received by the gate of the drive transistor Td, is dependent upon the threshold voltage of the drive transistor Td, the drive transistor Td can drive the Organic Light-Emitting Diode (OLED) by the current drive signal to emit light without the drain current of the drive transistor Td being dependent upon the threshold voltage of the drive transistor Td to thereby overcome the problem that drain current driving different pixels is different when the same signal is received by the pixels and improve the uniformity of display.

Preferably, the period of time in which the voltage of the first drive signal is not higher than the voltage of the second drive signal further includes a third period, where the third period precedes the first period; and both the first drive signal VD1 and the second drive signal VD2 are signals at a low level in the third period.

The drive module 12 is further configured to have the first end 1 of the drive module connected with the fourth end 4 of the drive module in the third period to thereby set the gate of the drive transistor Td to a low level, thus avoiding an influence of the previous drive signal on the display of the current frame of image signal.

Figure 3:
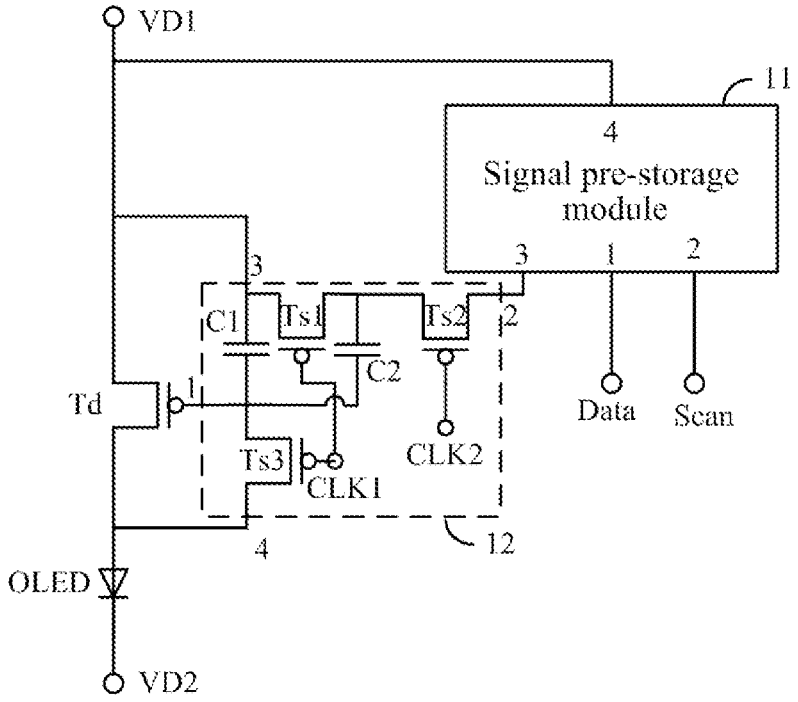
FIG. 3 is a simplified block of an organic light-emitting diode pixel circuit according to an embodiment of the invention.

Furthermore in the organic light-emitting diode pixel circuit according to the embodiment of the invention, as illustrated in FIG. 3, the drive module 12 includes a first switch transistor Ts1, a second switch transistor Ts2, a third switch transistor Ts3, a first capacitor C1 and a second capacitor C2.

One end of the first capacitor C1 is connected with the first end 1 of the drive module 12, and the other end of the first capacitor C1 is connected with the third end 3 of the drive module 12.

A first terminal of the first switch transistor Ts1 is connected with the third end 3 of the drive module 12, a gate of the first switch transistor Ts1 receives a first clock signal CLK1, a second terminal of the first switch transistor Ts1 is connected respectively with one end of the second capacitor C2 and a first terminal of the second switch transistor Ts2, the other end of the second capacitor C2 is the first end 1 of the drive module 12, a gate of the second switch transistor Ts2 receives a second clock signal CLK2, and a second terminal of the second switch transistor Ts2 is the second end 2 of the drive module 12.

A first terminal of the third switch transistor Ts3 is the first end 1 of the drive module 12, a gate of the third switch transistor Ts3 receives the first clock signal CLK1, and a second terminal of the third switch transistor Ts3 is the fourth end 4 of the drive module 12;

Both the first switch transistor Ts1 and the third switch transistor Ts3 are configured to be turned on in the first period and to be turned off in the second period by the first clock signal CLK1; and further to be turned on in the third period to thereby set the gate of the drive transistor Td to a low level, thus avoiding an influence of the previous drive signal;

The second switch transistor Ts2 is configured to be turned off in the first period and to be turned on in the second period by the second clock signal CLK2; and further to be turned off in the third period to avoid the influence of the first drive signal at a low level on the signal Data stored in the signal pre-storage module 11, in the current frame of image signal, to be displayed by the pixel including the pixel circuit.

Both the first capacitor C1 and the second capacitor C2 are configured, in the first period, to store the first drive signal VD1 and a signal dependent upon the threshold voltage Vth of the drive transistor Td, where the voltage of the signal dependent upon the threshold voltage Vth of the drive transistor Td is the sum of the voltage of the first drive signal and the threshold voltage of the drive transistor, i.e., Vd1+Vth; and in the second period, to be charged and discharged by the signal of the second end 2 of the drive module 12 (its voltage is VData), the stored first drive signal (its voltage is Vd1) and the stored signal dependent upon the threshold voltage Vth of the drive transistor Td (its voltage is Vd1+Vth) so that the voltage of the first terminal of the second switch transistor Ts2 is equal to the voltage of the second terminal of the second switch transistor Ts2.

Figure 4:
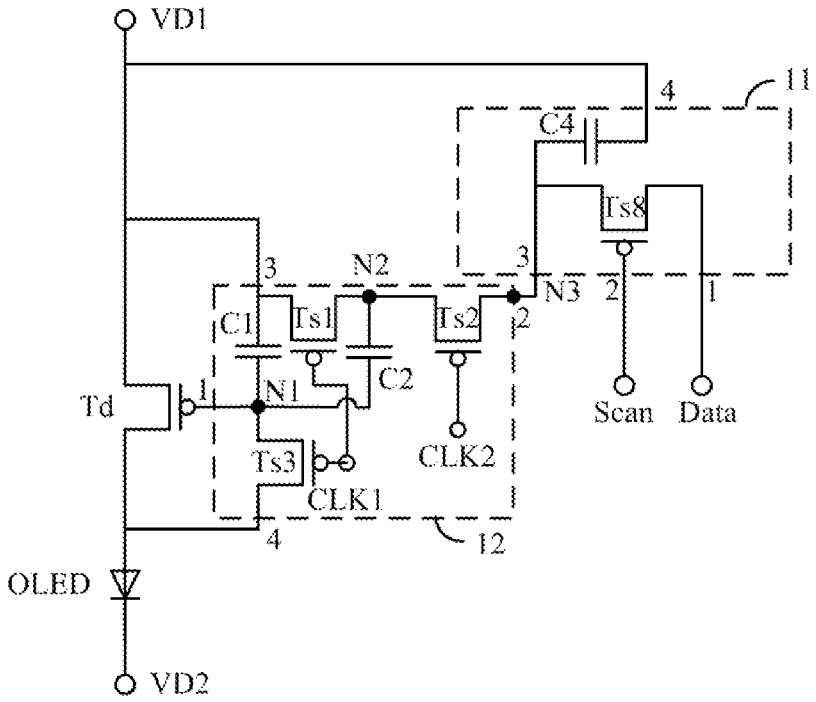
FIG. 4 is a circuit diagram of an organic light-emitting diode pixel circuit according to an embodiment of the invention.

Furthermore in the organic light-emitting diode pixel circuit according to the embodiment of the invention, as illustrated in FIG. 4, the signal pre-storage module 11 includes an eighth switch transistor Ts8 and a fourth capacitor C4.

A first terminal of the eighth switch transistor Ts8 is connected with the first end 1 of the signal pre-storage module 11, a gate of the eighth switch transistor Ts8 is connected with the second end 2 of the signal pre-storage module 11, and a second terminal of the eighth switch transistor Ts8 is connected with the third end 3 of the signal pre-storage module 11.

One end of the fourth capacitor C4 is connected with the third end 3 of the signal pre-storage module 11, and the other end of the fourth capacitor C4 is the fourth end 4 of the signal pre-storage module 11.

The eighth switch transistor Ts8 is configured to be turned on when the voltage of the first drive signal VD1 is higher than the voltage of the second drive signal VD2 and the gate line connected with the pixel including the pixel circuit is enabled and to be turned off when the gate line connected with the pixel is disabled.

The fourth capacitor C4 is configured to store a signal received when the eighth switch transistor Ts8 is turned on and to be charged and discharged by the signal stored in the fourth capacitor C4 when the voltage of the first drive signal VD1 is not higher than the voltage of the second drive signal VD2.

In the pixel circuit illustrated in FIG. 4, the voltage of a first node N1 is Vd1+Vth, the voltage of a second node N2 is Vd1 and the voltage of a third node N3 is Vdata in the first period, that is, when the first switch transistor Ts1 is turned on, the second switch transistor Ts2 is turned off, the third switch transistor Ts3 is turned on, and both the first drive signal VD1 and the second drive signal VD2 are at a high level. In the second period, that is, when the first switch transistor Ts1 is turned off, the second switch transistor Ts2 is turned on, the third switch transistor Ts3 is turned off, and both the first drive signal VD1 and the second drive signal VD2 are at a high level, both the first switch transistor Ts1 and the third switch transistor Ts3 are turned off, so the first capacitor C1 and the second capacitor C2 are connected in series into an equivalent capacitor $$Ce = \frac{C1 * C2}{C1 + C2};$$

and the second switch transistor Ts2 is turned on, so the equivalent capacitor Ce is connected in series with the fourth capacitor C4, but the voltage of the second node N2 is not equal to the voltage of the third node N3 before the equivalent capacitor Ce is connected in series with the fourth capacitor C4, so there will be a current flowing between the equivalent capacitor Ce and the fourth capacitor C4, so that the voltage of the second node N2 becomes equal to the voltage of the third node N3. When the charge redistribution is completed between the equivalent capacitor Ce and the fourth capacitor C4, that is, the voltage of the second node N2 is equal to the voltage of the third node N3, in accordance with the electric charge conservation law, the voltage of both the second node N2 and the third node N3 is $V_{N2N3}$, and a change of the amount of in the equivalent capacitor Ce is equal to a change of the amount of charges in the fourth capacitor C4, that is:

$$(V_{N2N3}-V_{N3})C4=(V_{N2}-V_{N2N3})Ce \qquad \text{Equation 1}$$

Wherein $V_{N2}$ is the voltage of the second node N2 before the equivalent capacitor Ce is connected in series with the fourth capacitor C4, and $V_{N3}$ is the voltage of the third node N3 before the equivalent capacitor Ce is connected in series with the fourth capacitor C4, so the following equation can be derived from Equation 1:

$$(V_{N2N3} - VData)C4 = (Vd1 - V_{N2N3})\frac{C1 * C2}{C1 + C2} \qquad \text{Equation 2}$$

And thus the following equation can be derived from Equation 2:

$$V_{N2N3} = \frac{(C1 + C2)C4 * VData + Vd1 * C1 * C2}{(C1 + C2)C4 + C1 * C2} \qquad \text{Equation 3}$$

After the voltage of the second node N2 is changed from $V_{N2}$ to $V_{N2N3}$, the voltage of the first node N1 will also be changed, for example, to the voltage of Vc, where the changed signal of the first node N1 is the current drive signal generated by the drive module 12 from the signal Data, in the current frame of image signal, to be displayed by the pixel including the pixel circuit, i.e., the current drive signal generated by the drive module 12 from the signal of the first end 1 of the drive module 12 and the signal of the second end 2 of the drive module 12. Likewise, in accordance with the electric charge conservation law:

$$(V_c-V_{N1})C1=[(V_{N2N3}-V_{N2})-(V_c-V_{N1})]C2 \qquad \text{Equation 4}$$

Where $V_{N1}$ is the voltage of the first node N1 before the equivalent capacitor Ce is connected in series with the fourth capacitor C4, $V_{N2}$ is the voltage of the second node N2 before the equivalent capacitor Ce is connected in series with the fourth capacitor C4, $V_{N2N3}$ is the voltage of both the second node N2 and the third node N3 after the charge redistribution is completed between the equivalent capacitor Ce and the fourth capacitor C4, and Vc is the voltage of the first node N1 after the charge redistribution is completed between the equivalent capacitor Ce and the fourth capacitor C4, so the following equation can be derived from Equation 4:

$$V_c = \frac{V_{N2N3} * C2 + Vd1 * C1}{C1 + C2} + Vth \qquad \text{Equation 5}$$

And the following equation can be derived from Equations 3 and 5:

$$V_c = Vd1 + Vth - \frac{C2 * C4 * (Vd1 - VData)}{(C1 + C2) * C4 + C1 * C2} \qquad \text{Equation 6}$$

As can be apparent from Equation 6, the voltage of the current drive signal, which is generated by the drive module from the signal Data, in the current frame of image signal, to be displayed by the pixel including the pixel circuit, is dependent upon the first drive signal VD1 and also upon the threshold voltage of the drive transistor Td, so the drive transistor Td can be controlled by the signal of the gate thereof, i.e., the current drive signal, to drive the Organic Light-Emitting Diode (OLED) to emit light when the voltage of the first drive signal VD1 is higher than the voltage of the second drive signal VD2 at the end of the second period. A current of a transistor operating in a saturation region can be determined by:

$$i_D = \frac{K}{2}(Vgs - Vth)^2 \quad \text{Equation 7}$$

Where K is a structural parameter, the value of which is relatively stable with the same structure; Vgs is the voltage difference between a gate and a source of the transistor, and Vth is the threshold voltage of the transistor, so the drain current of the drive transistor Td is:

$$i_D = \frac{K}{2}(V_c - Vd1 - Vth)^2 = \frac{K}{2}\left(\frac{C2 * C4 * (Vd1 - VData)}{(C1 + C2) * C4 + C1 * C2}\right)^2 \quad \text{Equation 8}$$

Thus, when the organic light-emitting diode is driven by the current drive signal in Equation 6 to emit light, both the problem of degraded uniformity of display due to the threshold voltage of the drive transistor Td and the problem of degraded uniformity of display due to a decrease in voltage across a transmission line of the first drive signal VD1 can be overcome.

Optionally, in the organic light-emitting diode pixel circuit illustrated in FIG. 2, the period of time, in which the voltage of the first drive signal is not higher than the voltage of the second drive signal, further includes a fourth period, where the fourth period follows the second period; and both the first drive signal and the second drive signal are signals at a high level in the fourth period.

The drive module 12 is further configured, in the fourth period, to have the first end 1 of the drive module 12 disconnected from the fourth end 4 of the drive module 12, to control the third end 3 of the signal pre-storage module 11 to be disconnected from the drive module 12 and to control the source of the drive transistor Td to be connected with the drive module 12 at the third end 3 of the drive module 12.

In the fourth period, the current drive signal has been generated and loaded to the gate of the drive transistor Td, but the Organic Light-Emitting Diode (OLED) cannot emit light yet because both the first drive signal VD1 and the second drive signal VD2 are at a high level. This can ensure the Organic Light-Emitting Diode (OLED) to emit light after the first end 1 of the drive module 12 is disconnected from the fourth end 4 of the drive module 12, that is, to emit light after the drain of the drive transistor Td is disconnected from the gate of the drive transistor Td, to thereby avoid the influence of the first drive signal VD1 on the signal of the gate of the drive transistor Td, i.e., the current drive signal.

Figure 5A:
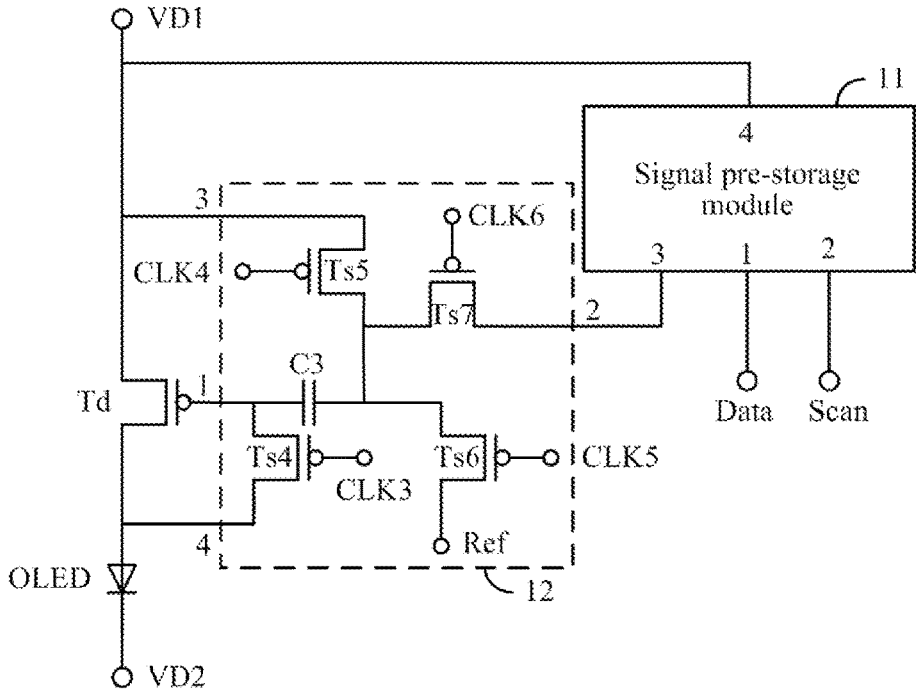
FIG. 5*a* is a simplified block of an organic light-emitting diode pixel circuit according to an embodiment of the invention.
Figure 5B:
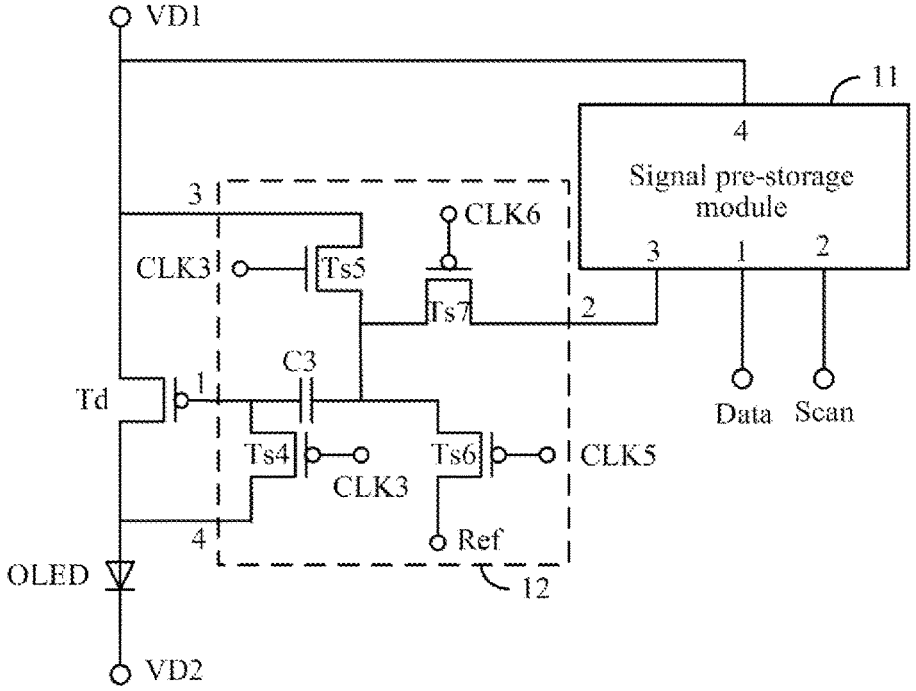
FIG. 5*b* is a simplified block of an organic light-emitting diode pixel circuit according to an embodiment of the invention.

Furthermore in the organic light-emitting diode pixel circuit according to the embodiment of the invention, as illustrated in FIG. 5*a* and FIG. 5*b*, the drive module includes a fourth switch transistor Ts4, a fifth switch transistor Ts5, a sixth switch transistor Ts6, a seventh switch transistor Ts7 and a third capacitor C3.

A first terminal of the fourth switch transistor Ts4 is connected with the first end 1 of the drive module 12, a gate of the fourth switch transistor Ts4 receives a third clock signal CLK3, and a second terminal of the fourth switch transistor Ts4 is connected with the fourth end 4 of the drive module 12.

One end of the third capacitor C3 is connected with the first end 1 of the drive module 12, and the other end of the third capacitor C3 is connected respectively with a first terminal of the fifth switch transistor Ts5, a first terminal of the sixth switch transistor Ts6 and a first terminal of the seventh switch transistor Ts7. A gate of the fifth switch transistor Ts5 receives a fourth clock signal CLK4, and a second terminal of the fifth switch transistor Ts5 is connected with the third end 3 of the drive module 12; a gate of the sixth switch transistor Ts6 receives a fifth clock signal CLK5, and a second terminal of the sixth switch transistor Ts6 receives a reference signal Ref; and a gate of the seventh switch transistor Ts7 receives a sixth clock signal CLK6, and a second terminal of the seventh switch transistor Ts7 is connected with the second end 2 of the drive module 12.

The fourth switch transistor Ts4 is configured to be turned on in both the first period and the second period, to be turned off in the fourth period and to be turned on in the third period to thereby set the gate of the drive transistor Td to a low level, thus avoiding an influence of the previous drive signal.

The fifth switch transistor Ts5 is configured to be turned off in both the first period and the second period, to be turned on in the fourth period and to be turned off in the third period.

The sixth switch transistor Ts6 is configured to be turned on in the first period, to be turned off in both the second period and the fourth period; and to be turned on in the third period to thereby set the one end of the third capacitor C3 disconnected from the gate of the drive transistor Td to the voltage of the reference signal Ref;

The seventh switch transistor Ts7 is configured to be turned off in both the first period and the fourth period, and to be turned on in the second period; and to be turned off in the third period to thereby avoid an influence of the reference signal Ref on the signal stored in the signal pre-storage module 11.

The third capacitor C3 is configured, in the first period, to store the reference signal Ref and a signal dependent upon the threshold voltage Vth of the drive transistor Td, where the voltage of the signal dependent upon the threshold voltage Vth of the drive transistor Td is the sum of the voltage of the first drive signal VD1 and the threshold voltage Vth of the drive transistor Td, i.e., Vd1+Vth; in the second period, to be charged and discharged by the signal of the second end 2 of the drive module 12 (i.e., the signal Data, in the current frame of image signal, to be displayed by the pixel including the pixel circuit), the stored reference signal Ref and the stored signal dependent upon the threshold voltage Vth of the drive transistor Td so that the voltage of the first terminal of the seventh switch transistor Ts7 is equal to the voltage of the second terminal of the seventh switch transistor Ts7; and in the fourth period, to couple a change in voltage of the first terminal of the fifth switch transistor Ts5 to the gate of the drive transistor Td.

The fifth switch transistor Ts5 is a p-type transistor in the pixel circuit illustrated in FIG. 5*a*. The fifth switch transistor Ts5 is an n-type transistor in the pixel circuit illustrated in FIG. 5*b*. When the fifth switch transistor Ts5 is an n-type transistor and the fourth switch transistor Ts4 is a p-type transistor, the fourth clock signal CLK4 is the same as the third clock signal CLK3, so both the fourth switch transistor Ts4 and the fifth switch transistor Ts5 can be controlled by the third clock signal CLK3.

The signal pre-storage module 11 in the pixel circuit illustrated in FIG. 5*a* and FIG. 5*b* can be structured as the signal pre-storage module in the pixel circuit illustrated in FIG. 4 or of course can be structured otherwise as long as the function of the signal pre-storage module can be performed. When the signal pre-storage module 11 in the pixel circuit illustrated in FIG. 5*a* is structured as the signal pre-storage module in the pixel circuit illustrated in FIG. 4, the pixel circuit illustrated in FIG. 5*a* is as illustrated in FIG. 6*a*; and when the signal pre-storage module 11 in the pixel circuit illustrated in FIG. 5*b* is structured as the signal pre-storage module in the pixel circuit illustrated in FIG. 4, the pixel circuit illustrated in FIG. 5*b* is as illustrated in FIG. 6*b*.

Figure 6A:
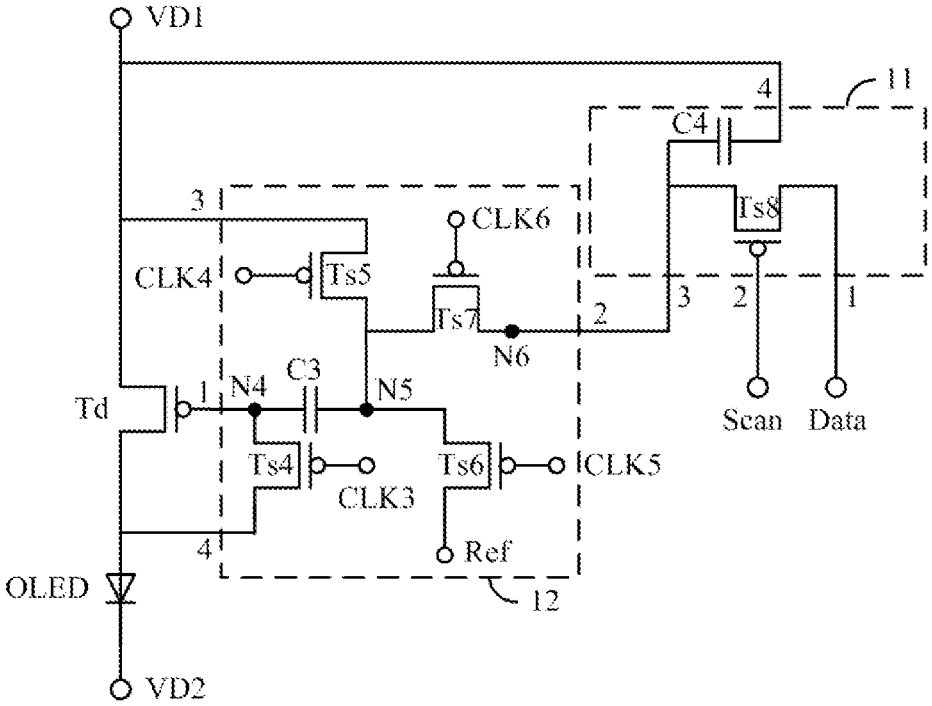
FIG. 6*a* is a circuit diagram of an organic light-emitting diode pixel circuit according to an embodiment of the invention.
Figure 6B:
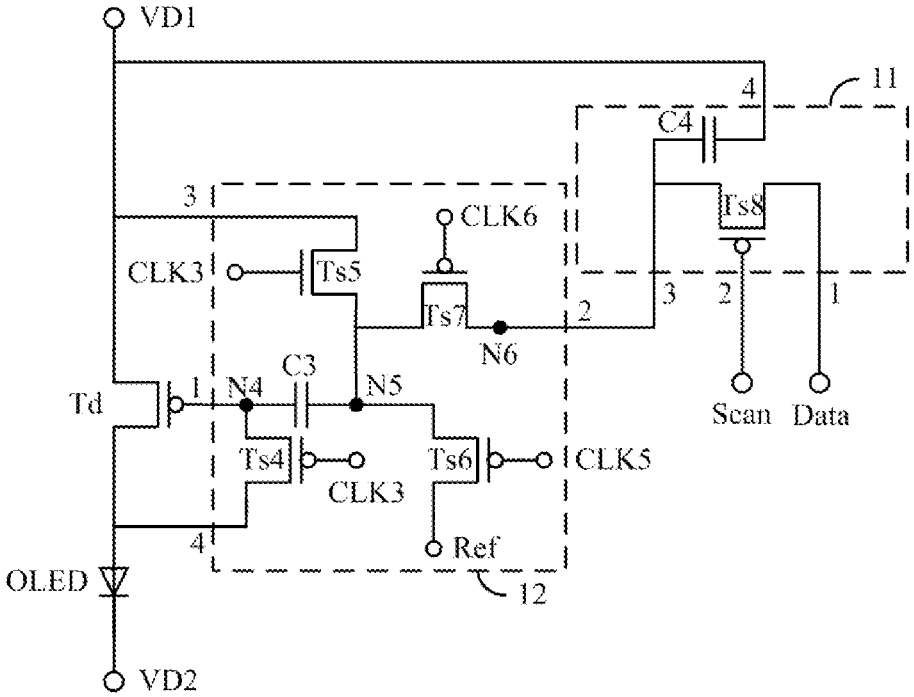
FIG. 6*b* is a circuit diagram of an organic light-emitting diode pixel circuit according to an embodiment of the invention.

In the pixel circuit as illustrated in FIG. 6*a* and FIG. 6*b*, the voltage of a fourth node N4 is Vd1+Vth, the voltage of a fifth node N5 is the voltage Vref of the reference signal Ref and the voltage of a sixth node N6 is Vdata in the first period, that is, when the fourth switch transistor Ts4 is turned on, the fifth switch transistor Ts5 is turned off, the sixth switch transistor Ts6 is turned on, the seventh switch transistor Ts7 is turned off, and both the first drive signal VD1 and the second drive signal VD2 are at a high level. In the second period, that is, when the fourth switch transistor Ts4 is turned on, the fifth switch transistor Ts5 is turned off, the sixth switch transistor Ts6 is turned off, the seventh switch transistor Ts7 is turned on, and both the first drive signal VD1 and the second drive signal VD2 are at a high level, since the voltage of the fifth node N5 is unequal to the voltage of the sixth node N6 before the seventh switch transistor Ts7 is turned on, so there will be current between the third capacitor C3 and the fourth capacitor C4, so that the voltage of the fifth node N5 is equal to the voltage of the sixth node N6. Given charging and discharging completed between the third capacitor C3 and the fourth capacitor C4, that is, the voltage of the fifth node N5 being equal to the voltage of the sixth node N6, as can be apparent from the charge conservation law, the voltage of both the fifth node N5 and the sixth node N6 is $V_{N5N6}$, and a change of the amount of charges in the third capacitor C3 is equal to a change of the amount of charges in the fourth capacitor C4, that is:

$$(V_{N5N6}-V_{N6})C4=(V_{N5}-V_{N5N6})C3 \qquad \text{Equation 9}$$

Where $V_{N5}$ is the voltage Vref of the fifth node N5 before the third capacitor C3 is connected in series with the fourth capacitor C4, that is, before the seventh switch transistor Ts7 is turned on, and $V_{N6}$ is the voltage VData of the sixth node N6 before the third capacitor C3 is connected in series with the fourth capacitor C4, so the following equation can be derived from Equation 9:

$$V_{N5N6} = \frac{C4 * VData + Vref * C3}{C3 + C4} \qquad \text{Equation 10}$$

And the voltage difference across the third capacitor C3 after the charge redistribution is completed between the third capacitor C3 and the fourth capacitor C4 is:

$$V_{N4} - V_{N5N6} = Vd1 + Vth - \frac{C4 * VData + Vref * C3}{C3 + C4} \qquad \text{Equation 11}$$

When the fourth period is entered at the end of the second period, that is, when all of the fourth switch transistor Ts4, the sixth switch transistor Ts6 and the seventh switch transistor Ts7 are turned off, the fifth switch transistor Ts5 is turned on, and both the first drive signal VD1 and the second drive signal VD2 are at a high level, the third capacitor C3 is being neither charged nor discharged although the voltage of one end of the third capacitor C3 jumps from $V_{N5N6}$ to Vd1, so the amount of charges on the third capacitor C3, i.e., the voltage difference across the third capacitor C3, will not be changed, and the voltage difference across the third capacitor C3 (in Equation 11) is the voltage difference between the gate and the source of the drive transistor Td. Thus as can be apparent from Equation 7, when the voltage of the first drive signal VD1 is higher than the voltage of the second drive signal VD2, that is, the first drive signal VD1 is a signal at a high level, and the second drive signal VD2 is a signal at a low level, the drain current of the drive transistor Td is:

$$i_D = \frac{K}{2}(V_{N4} - V_{N5N6} - Vth)^2 = \frac{K}{2}\left(Vd1 - \frac{C4 * VData + Vref * C3}{C3 + C4}\right)^2 \qquad \text{Equation 12}$$

When the value of the third capacitor C3 is the same as the value of the fourth capacitor C4 and the voltage Vref of the reference signal Ref is twice the voltage of the first drive signal VD1 at a high level, as can be apparent from Equation 12, the drain current of the drive transistor Td is:

$$i_D = \frac{K}{2}\left(\frac{VData}{2}\right)^2 \qquad \text{Equation 13}$$

Thus when the third capacitor C3 has the same value as the fourth capacitor C4 and the voltage Vref of the reference signal Ref is twice the voltage of the first drive signal VD1 at a high level, both the problem of degraded uniformity of display due to the threshold voltage of the drive transistor Td and the problem of degraded uniformity of display due to a decrease in voltage across a transmission line of the first drive signal VD1 can be overcome by driving the organic light-emitting diode by the current drive signal to emit light.

The term "first terminal" of a switch transistor as referred to in the embodiments of the invention can be a source (or a drain) of the switch transistor, and the term "second terminal" of the switch transistor can be the drain (or the source) of the switch transistor. If the source of the switch transistor is the first terminal, then the drain of the switch transistor is the second terminal; and if the drain of the switch transistor is the first terminal, then the source of the switch transistor is the second terminal.

In order to further describe the organic light-emitting diode pixel circuit according to the embodiments of the invention, an operation principle of the pixel circuit illustrated in FIG. 4 will be described below in connection with a timing diagram illustrated in FIG. 7 by way of example where the first switch transistor Ts1, the second switch transistor Ts2, the third switch transistor Ts3 and the eighth switch transistor Ts8 are p-type transistors.

Figure 7:
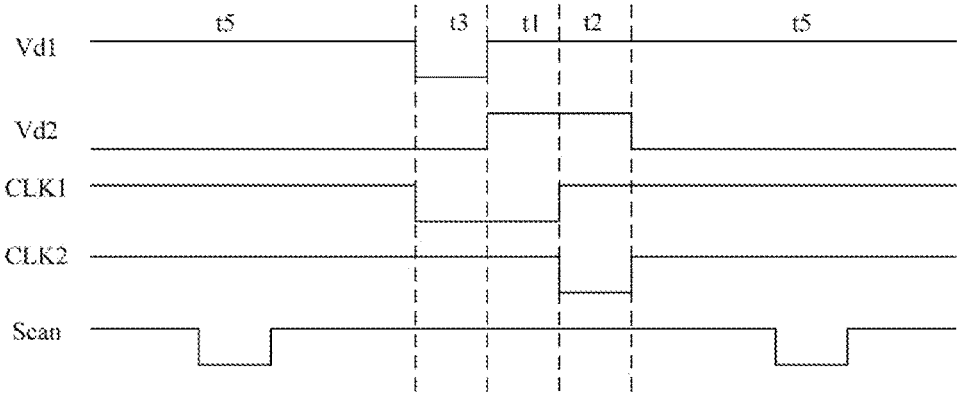
FIG. 7 is a timing diagram of the pixel circuit illustrated in FIG. 4 in operation.

As illustrated in FIG. 7, an operation process of the pixel circuit illustrated in FIG. 4 includes a reset phase (i.e., a third period t3), a threshold voltage reading phase (i.e., a first period t1), a drive signal generation phase (i.e., a second period t2) and a light emitting phase (i.e., a fifth period t5).

In the third period t3, the first clock signal CLK1 is at a low level, the first switch transistor Ts1 is turned on, and the third switch transistor Ts3 is turned on; and the second clock signal CLK2 is at a high level, the second switch transistor Ts2 is turned off, and both the first drive signal VD1 and the second drive signal VD2 are at a low level, so the gate and the drain of the drive transistor Td are connected, both ends of the first capacitor C1 are at a low level, and both ends of the second capacitor C2 are at a low level, thereby removing a residual signal of the displayed previous frame of image data signal on the first capacitor C1 and the second capacitor C2 and avoiding an influence of the previous frame of image data signal on the displayed current frame of image data signal. In addition, the second switch transistor Ts2 is turned off to thereby avoid interference of the low level to the signal stored in the fourth capacitor C4, in the current frame of image signal, to be displayed by the pixel including the pixel circuit. The gate line scan signal Scan is at a high level, so the eighth switch transistor Ts8 is turned off, that is, no further image signal is stored in the fourth capacitor C4 in the third period t3.

In the first period t1, the first clock signal CLK1 is at a low level, the first switch transistor Ts1 is turned on, and the third switch transistor Ts3 is turned on; and the second clock signal CLK2 is at a high level, the second switch transistor Ts2 is turned off, and both the first drive signal VD1 and the second drive signal VD2 are at a high level, so the gate and the drain of the drive transistor Td are connected, the voltage of the first node N1 is the sum of the voltage of the first drive signal VD1 and the threshold voltage of the drive transistor Td, i.e., Vd1+Vth, and the voltage of the second node N2 is the voltage Vd1 of the first drive signal VD1. In the first period t1, the drive module reads and stores the threshold voltage of the drive transistor Td. In the first period t1, the gate line scan signal Scan is at a high level, and the eighth switch transistor Ts8 is turned off.

In the second period t2, the first clock signal CLK1 is at a high level, the first switch transistor Ts1 is turned off, and the third switch transistor Ts3 is turned off; and the second clock signal CLK2 is at a low level, the second switch transistor Ts2 is turned on, and both the first drive signal VD1 and the second drive signal VD2 are at a high level. Since the first switch transistor Ts1 is turned off, the first capacitor C1 is connected in series with the second capacitor C2; since the third switch transistor Ts3 is turned off, the gate and the drain of the drive transistor Td are disconnected; and since the second switch transistor Ts2 is turned on, the first capacitor C1, the second capacitor C2 and the fourth capacitor C4 are connected in series, and charge redistributions are performed among these three capacitors so that the voltage of the second node N2 is equal to the voltage of the third node N3. When the voltage of the second node N2 is equal to the voltage of the third node N3, the drive module generates the current drive signal, i.e., the signal of the first node N1 when the voltage of the second node N2 is equal to the voltage of the third node N3, from the signal stored in the fourth capacitor C4, in the current frame of image signal, to be displayed by the pixel including the pixel circuit. In the second period t2, the gate line scan signal Scan is at a high level, and the eighth switch transistor Ts8 is turned off.

In the fifth period t5, the first clock signal CLK1 is at a high level, the first switch transistor Ts1 is turned off, and the third switch transistor Ts3 is turned off; and the second clock signal CLK2 is at a high level, the second switch transistor Ts2 is turned off, the first drive signal VD1 is at a high level, and the second drive signal VD2 is at a low level. Since the third switch transistor Ts3 is turned off, the gate and the drain of the drive transistor Td are disconnected; and since the second switch transistor Ts2 is turned off, the drive module is independent from the signal pre-storage module without transmission of any signal between them. The drive transistor Td is controlled by the current drive signal of the gate thereof to drive the Organic Light-Emitting Diode (OLED) to emit light; and when the gate line scan signal Scan is at a low level, that is, the gate line connected with the pixel including the pixel circuit is enabled, the eighth switch transistor Ts8 is turned on, so that a signal, in a next frame of image signal to the current frame of image signal, to be displayed by the pixel, is stored into the fourth capacitor C4.

In order to further describe the organic light-emitting diode pixel circuit according to the embodiment of the invention, an operation principle of the pixel circuit illustrated in FIG. 6*a* will be described below in connection with a timing diagram illustrated in FIG. 8*a* by way of example where the fourth switch transistor Ts4, the fifth switch transistor Ts5, the sixth switch transistor Ts6, the seventh switch transistor Ts7 and the eighth switch transistor Ts8 are p-type transistors; and an operation principle of the pixel circuit illustrated in FIG. 6*b* will be described below in connection with a timing diagram illustrated in FIG. 8*b* by way of example where the fourth switch transistor Ts4, the sixth switch transistor Ts6, the seventh switch transistor Ts7 and the eighth switch transistor Ts8 are p-type transistors and the fifth switch transistor Ts5 is an n-type transistor.

Figure 8A:
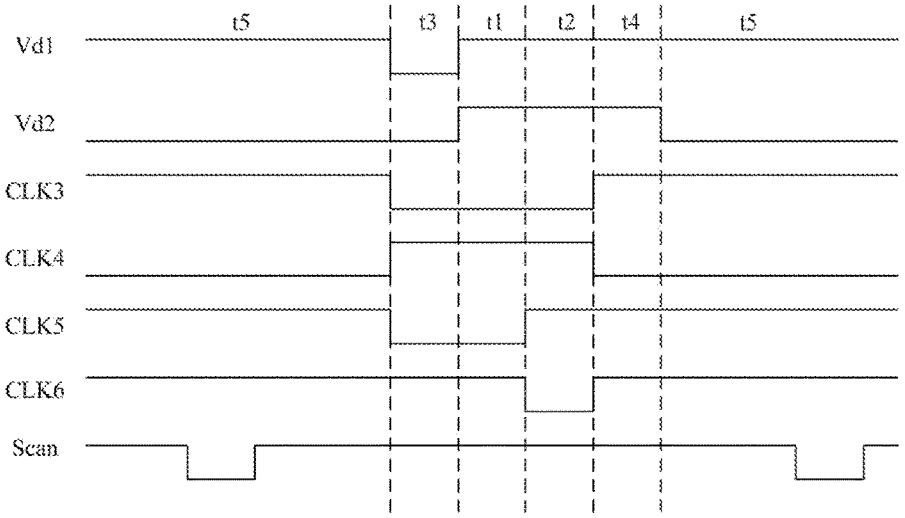
FIG. 8*a* is a timing diagram of the pixel circuit illustrated in FIG. 6*a* in operation.

FIG. 8*a* illustrates a timing diagram of the organic light-emitting diode pixel circuit including the fifth switch transistor Ts5 which is a p-type transistor according to the embodiment of the invention (the circuit illustrated in FIG. 6*a*) in operation. FIG. 8*b* illustrates a timing diagram of the organic light-emitting diode pixel circuit including the fifth switch transistor Ts5 which is an n-type transistor according to the embodiment of the invention (the circuit illustrated in FIG. 6*b*) in operation, where the third clock signal CLK3 is the same as the fourth clock signal CLK4, so only a timing diagram of the third clock signal CLK3 is shown in FIG. 8*b*.

Figure 8B:
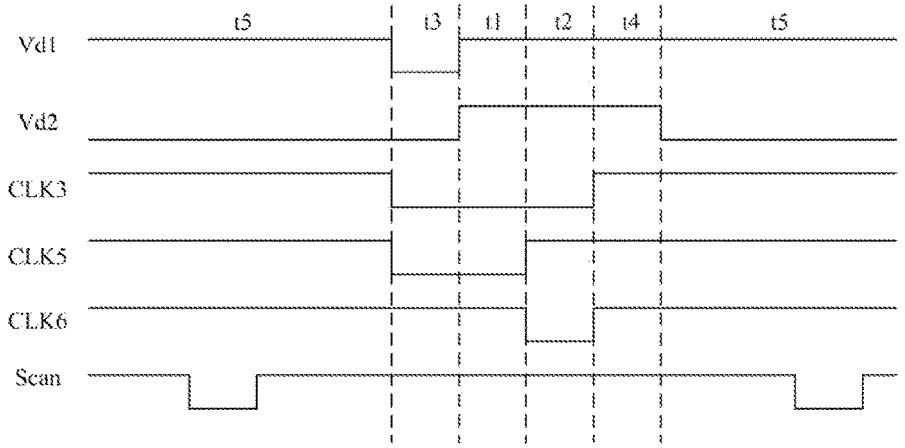
FIG. 8*b* is a timing diagram of the pixel circuit illustrated in FIG. 6*b* in operation.

As illustrated in FIG. 8*a* and FIG. 8*b*, an operation process of the pixel circuit illustrated in FIG. 6*a* and FIG. 6*b* includes a reset phase (i.e., a third period t3), a threshold voltage reading phase (i.e., a first period t1), a drive signal generation phase (i.e., a second period t2), a wait phase (i.e., a fourth phase t4) and a light emitting phase (i.e., a fifth period t5).

In the third period t3, in FIG. 8*a*, the third clock signal CLK3 is at a low level, the fourth switch transistor Ts4 is turned on, the fourth clock signal CLK4 is at a high level, the fifth switch transistor Ts5 is turned off, the fifth clock signal CLK5 is at a low level, the sixth switch transistor Ts6 is turned on, the sixth clock signal CLK6 is at a high level, the seventh switch transistor Ts7 is turned off, and both the first drive signal VD1 and the second drive signal VD2 are at a low level; and in FIG. 8*b*, the third clock signal CLK3 is at a low level, the fourth switch transistor Ts4 is turned on, the fifth switch transistor Ts5 is turned off, the fifth clock signal CLK5 is at a low level, the sixth switch transistor Ts6 is turned on, the sixth clock signal CLK6 is at a high level, the seventh switch transistor Ts7 is turned off, and both the first drive signal VD1 and the second drive signal VD2 are at a low level. Since the fourth switch transistor Ts4 is turned on, the gate and the drain of the drive transistor Td are connected, and also since the first drive signal is at a low level, the voltage of the fourth node N4 is at a low level; and since the sixth switch transistor Ts6 is turned on, the voltage of the fifth node N5 is the voltage Vref of the reference signal Ref, thereby removing a residual signal of the displayed previous frame of image data signal on the third capacitor C3 and avoiding an influence of the previous frame of image data signal on the displayed current frame of image data signal. Moreover the seventh switch transistor Ts7 is turned off to thereby avoid interference of the reference signal Ref to the signal Data stored in the fourth capacitor C4, in the current frame of image signal, to be displayed by the pixel including the pixel circuit. The gate line scan signal Scan is at a high level, so the eighth switch transistor Ts8 is turned off, that is, no further image signal is stored in the fourth capacitor C4 in the third period t3.

In the first period t1, in FIG. 8*a*, the third clock signal CLK3 is at a low level, the fourth switch transistor Ts4 is turned on, the fourth clock signal CLK4 is at a high level, the fifth switch transistor Ts5 is turned off, the fifth clock signal CLK5 is at a low level, the sixth switch transistor Ts6 is turned on, the sixth clock signal CLK6 is at a high level, the seventh switch transistor Ts7 is turned off, and both the first drive signal VD1 and the second drive signal VD2 are at a high level; and in FIG. 8*b*, the third clock signal CLK3 is at a low level, the fourth switch transistor Ts4 is turned on, the fifth switch transistor Ts5 is turned off, the fifth clock signal CLK5 is at a low level, the sixth switch transistor Ts6 is turned on, the sixth clock signal CLK6 is at a high level, the seventh switch transistor Ts7 is turned off, and both the first drive signal VD1 and the second drive signal VD2 are at a high level, so the gate and the drain of the drive transistor Td are connected, the voltage of the fourth node N4 is the sum of the voltage of the first drive signal VD1 and the threshold voltage of the drive transistor Td, i.e., Vd1+Vth, and the voltage of the fifth node N5 is the voltage Vref of the reference signal Ref. In the first period t1, the drive module reads and stores the threshold voltage of the drive transistor Td. In the first period t1, the gate line scan signal Scan is at a high level, and the eighth switch transistor Ts8 is turned off.

In the second period t2, in FIG. 8*a*, the third clock signal CLK3 is at a low level, the fourth switch transistor Ts4 is turned on, the fourth clock signal CLK4 is at a high level, the fifth switch transistor Ts5 is turned off, the fifth clock signal CLK5 is at a high level, the sixth switch transistor Ts6 is turned off, the sixth clock signal CLK6 is at a low level, the seventh switch transistor Ts7 is turned on, and both the first drive signal VD1 and the second drive signal VD2 are at a high level; and in FIG. 8*b*, the third clock signal CLK3 is at a low level, the fourth switch transistor Ts4 is turned on, the fifth switch transistor Ts5 is turned off, the fifth clock signal CLK5 is at a high level, the sixth switch transistor Ts6 is turned off, the sixth clock signal CLK6 is at a low level, the seventh switch transistor Ts7 is turned on, and both the first drive signal VD1 and the second drive signal VD2 are at a high level. Since the seventh switch transistor Ts7 is turned off, the third capacitor C3 and the fourth capacitor C4 are connected in series, and charging and discharging are performed among these three capacitors so that the voltage of the fifth node N5 is equal to the voltage of the sixth node N6; and since the fourth switch transistor Ts4 is turned on, the gate and the drain of the drive transistor Td are connected. In the second period t2, the gate line scan signal Scan is at a high level, and the eighth switch transistor Ts8 is turned off. When the voltage of the fifth node N5 is equal to the voltage of the sixth node N6, the drive module generates the current drive signal, i.e., the signal of the fifth node N5 when the voltage of the fifth node N5 is equal to the voltage of the sixth node N6, from the signal stored in the fourth capacitor C4, in the current frame of image signal, to be displayed by the pixel including the pixel circuit. In the second period t2, the gate line scan signal Scan is at a high level, and the eighth switch transistor Ts8 is turned off.

In the fourth period t4, in FIG. 8*a*, the third clock signal CLK3 is at a high level, the fourth switch transistor Ts4 is turned off, the fourth clock signal CLK4 is at a low level, the fifth switch transistor Ts5 is turned on, the fifth clock signal CLK5 is at a high level, the sixth switch transistor Ts6 is turned off, the sixth clock signal CLK6 is at a high level, the seventh switch transistor Ts7 is turned off, and both the first drive signal VD1 and the second drive signal VD2 are at a high level; and in FIG. 8*b*, the third clock signal CLK3 is at a high level, the fourth switch transistor Ts4 is turned off, the fifth switch transistor Ts5 is turned on, the fifth clock signal CLK5 is at a high level, the sixth switch transistor Ts6 is turned off, the sixth clock signal CLK6 is at a high level, the seventh switch transistor Ts7 is turned off, and both the first drive signal VD1 and the second drive signal VD2 are at a high level. The third capacitor C3 and the fourth capacitor C4 can be charged and discharged in the second period t2 so that the voltage of the fifth node N5 is equal to the voltage of the sixth node N6; and after the voltage of the fifth node N5 is equal to the voltage of the sixth node N6, since the fifth switch transistor Ts5 is turned on, the voltage of the fifth node N5 is changed, that is, from the signal dependent upon the current drive signal to a signal at a high level, and the third capacitor C3 couples the change in voltage of the fifth node N5 to the fourth node N4, and at this time the signal of the fourth node N4 is the current drive signal. Also in the fourth period t4, the drive module can ensure the gate of the drive transistor Td to be disconnected from the drain thereof before driving the Organic Light-Emitting Diode (OLED) to emit light. In the fourth period t4, the gate line scan signal Scan is at a high level, and the eighth switch transistor Ts8 is turned off.

In the fifth period t5, in FIG. 8*a*, the third clock signal CLK3 is at a high level, the fourth switch transistor Ts4 is turned off, the fourth clock signal CLK4 is at a low level, the fifth switch transistor Ts5 is turned on, the fifth clock signal CLK5 is at a high level, the sixth switch transistor Ts6 is turned off, the sixth clock signal CLK6 is at a high level, the seventh switch transistor Ts7 is turned off, the first drive signal VD1 is at a high level, and the second drive signal VD2 is at a low level; and in FIG. 8*b*, the third clock signal CLK3 is at a high level, the fourth switch transistor Ts4 is turned off, the fifth switch transistor Ts5 is turned on, the fifth clock signal CLK5 is at a high level, the sixth switch transistor Ts6 is turned off, the sixth clock signal CLK6 is at a high level, the seventh switch transistor Ts7 is turned off, the first drive signal VD1 is at a high level, and the second drive signal VD2 is at a low level. Since the fourth switch transistor is turned off, the gate of the drive transistor is disconnected from the drain thereof; Since the seventh switch transistor Ts7 is turned off, the drive module is independent from the signal pre-storage module without transmission of any signal between them. The drive transistor Td is controlled by the current drive signal of the gate thereof to drive the Organic Light-Emitting Diode (OLED) to emit light; and when the gate line scan signal Scan is at a low level, that is, the gate line connected with the pixel including the pixel circuit is enabled, the eighth switch transistor Ts8 is turned on, so that a signal, in a next frame of image signal to the current frame of image signal, to be displayed by the pixel, is stored into the fourth capacitor C4.

A display panel according to an embodiment of the invention includes the organic light-emitting diode pixel circuit according to the embodiment of the invention.

A display device according to an embodiment of the invention includes the display panel according to the embodiment of the invention.

A method for driving an organic light-emitting diode pixel circuit according to an embodiment of the invention, applicable to the organic light-emitting diode pixel circuit according to the embodiment of the invention, includes:

The signal pre-storage module stores the signal received by the first end of the signal pre-storage module, in the current frame of image signal, to be displayed by the pixel, when the voltage of the first drive signal is higher than the voltage of the second drive signal and the gate line connected with the pixel is enabled;

The drive module drives the drive transistor by the first end of the drive module using the previous drive signal to enable the organic light-emitting diode to emit light when the voltage of the first drive signal is higher than the voltage of the second drive signal, where the previous drive signal is generated by the drive module from a signal, in the previous frame of image signal to the current frame of image signal, to be displayed by the pixel; and The drive module generates the current drive signal from the signal stored in the signal pre-storage module, in the current frame of image signal, to be displayed by the pixel, when the voltage of the first drive signal is not higher than the voltage of the second drive signal.

Those skilled in the art can appreciate that the drawings are merely schematic diagrams of some preferred embodiments of the invention and the modules or flows in the drawings may not be necessarily required to implement the invention.

Those skilled in the art can appreciate that the modules in the devices according to the embodiments can be distributed in devices as described in the embodiments or located in one or more devices other than the embodiments in question while being modified correspondingly. The modules in the foregoing embodiments can be combined into a module or further divided into a plurality of sub-modules.

The foregoing embodiments of the invention have been numbered merely for the convenience of their description but will not indicate any precedence of one embodiment over the other.

Evidently those skilled in the art can make various modifications and variations to the invention without departing from the spirit and scope of the invention. Thus the invention is also intended to encompass these modifications and variations thereto so long as the modifications and variations come into the scope of the claims appended to the invention and their equivalents.

What is claimed is:

1. An organic light-emitting diode pixel circuit comprising:

an organic light-emitting diode (OLED);

a drive transistor, a first switch transistor, a second switch transistor, a third switch transistor, an eighth switch transistor; and a first capacitor, a second capacitor, a fourth capacitor;

wherein the drive transistor has a source for receiving a first drive signal, a drain connected with an anode of the OLED, and a gate connected respectively with a first terminal of the third switch transistor, one end of the first capacitor and one end of the second capacitor;

wherein the OLED has a cathode for receiving a second drive signal;

wherein the first capacitor has another end connected with the source of the drive transistor;

wherein the first switch transistor has a first terminal connected with the source of the drive transistor, a gate for receiving a first clock signal, a second terminal connected respectively with another end of the second capacitor and a first terminal of the second switch transistor;

wherein the second switch transistor has a gate for receiving a second clock signal, and a second terminal connected respectively with a second terminal of the eighth switch transistor and one end of the fourth capacitor;

wherein the third switch transistor has a gate for receiving the first clock signal, and a second terminal connected with the anode of the OLED;

wherein the eighth switch transistor has a first terminal for receiving a data signal, in a current frame of image signal, to be displayed by a pixel, and a gate for receiving a gate line scan signal configured to enable a gate line connected with the pixel;

wherein the fourth capacitor has another end connected with the source of the drive transistor.

2. The circuit according to claim 1, wherein:

in a period of time when a voltage of the first drive signal is not higher than a voltage of the second drive signal, the period of time comprises a first period and a second period, wherein the first period precedes the second period; and both the first drive signal and the second drive signal are at high levels in both the first period and the second period;

wherein both the first switch transistor and the third switch transistor are configured to be turned on in the first period and to be turned off in the second period by the first clock signal, wherein the second switch transistor is configured to be turned off in the first period and to be turned on in the second period by the second clock signal, and wherein both the first capacitor and the second capacitor are configured, in the first period, to store the first drive signal and a threshold signal dependent upon a threshold voltage, wherein the voltage of the threshold signal dependent upon the threshold voltage is the sum of the voltage of the first drive signal and the threshold voltage of the drive transistor; and wherein in the second period, both the first capacitor and the second capacitor are configured to be charge redistributed by the signal of the second terminal of the second switch transistor, the stored first drive signal and the stored threshold signal, so that the voltage of the first terminal of the second switch transistor is equal to the voltage of the second terminal of the second switch transistor.

3. The circuit according to claim 2, wherein in the period of time when the voltage of the first drive signal is not higher than the voltage of the second drive signal, the period of time further comprises a third period preceding the first period; wherein both the first drive signal and the second drive signal are at a low level in the third period; and wherein the first switch transistor and the third switch transistor are configured to be turned on in the third period by the first clock signal; and wherein the second switch transistor is configured to be turned off in the third period by the second clock signal.

4. The circuit according to claim 1, wherein the eighth switch transistor is configured to be turned on when the voltage of the first drive signal is higher than the voltage of the second drive signal, and wherein the gate line connected with the pixel is enabled to be turned off when the gate line connected with the pixel is disabled; and wherein the fourth capacitor is configured to store a signal received when the eighth switch transistor is turned on, and is charged and discharged by the signal stored in the fourth capacitor when the voltage of the first drive signal is not higher than the voltage of the second drive signal.

5. A display device, comprising the organic light-emitting diode pixel circuit according to claim 1.

6. An organic light-emitting diode pixel circuit comprising:

an organic light-emitting diode (OLED);

a drive transistor, a fourth switch transistor, a fifth switch transistor, a sixth switch transistor, a seventh switch transistor, and an eighth switch transistor; and a third capacitor, and a fourth capacitor;

wherein the drive transistor has a source for receiving a first drive signal, a drain connected with an anode of the OLED, and a gate connected respectively with a first terminal of the fourth switch transistor and one end of the third capacitor;

wherein the OLED has a cathode for receiving a second drive signal;

wherein the fourth switch transistor has a gate for receiving a third clock signal, and a second terminal connected with the anode of the OLED;

wherein the third capacitor has another end connected respectively with a first terminal of the fifth switch transistor, a first terminal of the sixth switch transistor, and a first terminal of the seventh switch transistor;

wherein the fifth switch transistor has a gate for receiving a fourth clock signal, and a second terminal connected with the source of the drive transistor;

wherein the sixth switch transistor has a gate for receiving a fifth clock signal, and a second terminal for receiving a reference signal;

wherein the seventh switch transistor has a gate for receiving a sixth clock signal, and a second terminal connected respectively with a second terminal of the eighth switch transistor and one end of the fourth capacitor;

wherein the eighth switch transistor has a first terminal for receiving a data signal, in a current frame of image signal, to be displayed by a pixel, and a gate for receiving a gate line scan signal configured to enable a gate line connected with the pixel; and wherein the fourth capacitor having another end connected with the source of the drive transistor.

7. The circuit according to claim 6, wherein a period of time when a voltage of the first drive signal is not higher than a voltage of the second drive signal, the period of time comprises a first period, a second period, and a fourth period, the first period preceding the second period, the fourth period following the second period; and wherein both the first drive signal and the second drive signal are at a high level in the first period, the second period and the fourth period;

wherein the fourth switch transistor are configured to be turned on in both the first period and the second period and to be turned off in the fourth period;

wherein the fifth switch transistor are configured to be turned off in both the first period and the second period and to be turned on in the fourth period;

wherein the sixth switch transistor are configured to be turned on in the first period and to be turned off in both the second period and the fourth period;

wherein the seventh switch transistor are configured to be turned off in both the first period and the fourth period and to be turned on in the second period; and wherein the third capacitor are configured, in the first period, to store the reference signal and a signal dependent upon the threshold voltage, wherein the voltage of the threshold signal dependent upon the threshold voltage is the sum of the voltage of the first drive signal and the threshold voltage of the drive transistor;

wherein in the second period, the third capacitor is configured to be charge redistributed by the signal of the second terminal of the seventh switch transistor, the stored reference signal and the stored threshold signal dependent upon the threshold voltage, so that the voltage of the first terminal of the seventh switch transistor is equal to the voltage of the second terminal of the seventh switch transistor; and in the fourth period, to couple a change in voltage of the first terminal of the fifth switch transistor to the gate of the drive transistor.

8. The circuit according to claim 7, wherein the period of time when the voltage of the first drive signal is not higher than the voltage of the second drive signal further comprises a third period preceding the first period; and wherein both the first drive signal and the second drive signal are at a low level in the third period; and wherein the fourth switch transistor is configured to be turned on in the third period to set the gate of the drive transistor to a low level;

wherein the fifth switch transistor is configured to be turned off in the third period;

wherein the sixth switch transistor is configured to be turned on in the third period to set the one end of the third capacitor disconnected from the gate of the drive transistor to the voltage of the reference signal; and wherein the seventh switch transistor is configured to be turned off in the third period.

9. The circuit according to claim 6, wherein the eighth switch transistor is configured to be turned on when the voltage of the first drive signal is higher than the voltage of the second drive signal, and the gate line connected with the pixel is enabled and turned off when the gate line connected with the pixel is disabled; and wherein the fourth capacitor is configured to store a signal received when the eighth switch transistor is turned on, and is charged and discharged by the signal stored in the fourth capacitor when the voltage of the first drive signal is not higher than the voltage of the second drive signal.

* * * * *